US005086956A

United States Patent [19]

Polhemus

[11] Patent Number: 5,086,956

[45] **Date of Patent: * Feb. 11, 1992**

[54] EASY-OPENING LEAK-RESISTANT LIQUID STORAGE AND DISPENSING CONTAINER

[75] Inventor: Marlan H. Polhemus, Chicago, Ill.

[73] Assignee: Mobil Oil Corporation, Fairfax, Va.

[ * ] Notice: The portion of the term of this patent subsequent to Feb. 19, 2008 has been disclaimed.

[21] Appl. No.: 636,519

[22] Filed: Dec. 31, 1990

Related U.S. Application Data

[63] Continuation-in-part of Ser. No. 464,516, Jan. 12, 1990, Pat. No. 4,993,603.

[51] Int. Cl.[5] ..... B65D 43/02; B65D 43/06

[52] U.S. Cl. ..... 222/472; 222/556

[58] Field of Search ..... 222/472, 556, 465.1, 222/556, 558, 572, 470, 472; 215/235; 220/335, 339, 281, 282

[56] References Cited

U.S. PATENT DOCUMENTS

| | | | |
|---|---|---|---|
| D. 284,944 | 8/1986 | Carlson | D9/425 |
| 2,805,561 | 9/1957 | Emment et al. | 222/465.1 X |
| 3,130,857 | 4/1964 | Burdick et al. | 220/43 |
| 3,512,686 | 5/1970 | Penniman | 222/472 |
| 3,696,957 | 10/1972 | Van Baarn | 215/41 |
| 3,853,250 | 12/1974 | Alpern | 222/517 |
| 4,027,775 | 6/1977 | Mygatt, Jr. et al. | 220/266 |
| 4,805,790 | 2/1989 | Leonetti et al. | 215/235 |
| 4,813,570 | 3/1989 | Pontoppidan | 220/306 |
| 4,993,603 | 2/1991 | Polhemus | 222/556 |
| 5,036,993 | 8/1991 | Ramsey | 222/472 |

*Primary Examiner*—Michael S. Huppert
*Assistant Examiner*—Philippe Derakshani
*Attorney, Agent, or Firm*—Alexander J. McKillop; Charles J. Speciale; Michael J. Mlotkowski

[57] ABSTRACT

A food storage container for dry or liquid foods and other open air perishable products provides a leak-resistant seal when the lid is in a closed position and easy pouring of contents when in the open position. The container is easy to open, employing rocker points to allow for a rocking action effective to release the lid from a closed position when a downward force is exerted upon an upper surface of the lid thereby providing an effective opening for pouring. A leak-resistant seal is achieved through the use of a plug section of the lid having a continuous outer peripheral surface which effects a close conforming fit with a similarly positioned surface area on the container body in a continuous and positive manner.

20 Claims, 11 Drawing Sheets

EASY-OPENING LEAK-RESISTANT LIQUID STORAGE AND DISPENSING CONTAINER

RELATED APPLICATION

This application is a continuation-in-part of co-pending application Ser. No. 07/464,516, filed on Jan. 12, 1990 now U.S. Pat. No. 4,993,603.

FIELD OF THE INVENTION

The present invention relates to a container assembly having a removable lid primarily designed for the storage of foods. More particularly, the present invention relates to a container assembly for use in the storage and dispensing of liquids and to a system for achieving a leak-resistant seal.

BACKGROUND OF THE INVENTION

Various containers for the storage of food, both liquid and dry are well known. Present day food containers, particularly those utilized for household storage applications display a wide variety of forms, closure systems, seals, and materials dedicated to the short term storage of a variety of dry and liquid foods. With the advent of newer plastic materials having improved properties better suited to meeting the standards and criteria of food container safety, such as higher temperature stability and the necessary structural requisites of flexibility or stiffness as may be required by an individual design, a proliferation of food containers of all types has been made available to the consumer.

The majority of these containers however display critical functional inadequacies and drawbacks in respect to easy opening and closing while attempting to maintain a watertight seal in a closed mode. In general, the tighter the cap or lid seal fits the container, the greater the force required for its removal. The negative implications of this judged in terms of known consumer desires and preferences for a simple easy to remove or operate cap or lid while at the same time having the assurance of a watertight seal are readily apparent.

The implications of such containers and their limited degree of operability are especially pointed in the case of the elderly, preferably those who suffer from arthritis and others who suffer some degree of motor impairment, and children.

Reusable food storage containers for the short term storage of liquid or dry foods, i.e. juices, cereals, meal leftovers, etc. may be classified into five groups. In the first group are those containers which have a simple interference fit lid. An example of such a container would be commercially available plastic ice cream containers, where consistent water tightness is not required. A second, well-known group utilizes screw-on type lids or caps, often provided with a species of elastomeric seal to provide water tightness. A third group relates to a combination form of the preceding groups in that a screw-top or snap-type lid is used in conjunction with an integrally molded pouring spout provision. A fourth classification embraces container types that depend upon a flexible lid that incorporates an instanding, positive continuous seal contour that engages and locks into a matching negative groove on the container lip. The fifth group consists of containers utilizing a plug-type of closure not always, but often, in conjunction with an elastomeric seal to promote water tightness.

U.S. Pat. No. 3,130,857 discloses circular containers with snap-off covers produced from relatively thin sheet metals for use in the storage of semi-solid materials. The cover of the container disclosed utilizes an arcuate cut-out portion and spaced apart fulcrum points formed by the terminal ends of the arcuate cut-out portion to unseat the cover from the container. As may be seen, the container is of the type commonly employed in the marketing of paste-type shoe polishes.

U.S. Pat. No. 3,696,957 discloses a fluid-tight and tamper-proof assembly comprising a container having a neck and a cap produced from an elastomeric material. The cap has a top portion and a skirt portion which engages around the neck. The outer surface of the neck is provided with at least two parallel collars and the inner portion of the skirt is provided with an equal number of annular ribs, the ribs forming with the inner surface of the skirt grooves in which the collars engage resiliently when the cap is forced onto the neck of the container.

U.S. Pat. No. 4,027,775 discloses a container and lid combination useful in the packaging of prepared foods. The container includes a continuous sidewall having at its upper end a rim forming an open mouth adapted to receive and retain the lid. The lid includes a peripheral skirt which extends downwardly for engaging the exterior of the container entirely along the peripheral surface portion of the container below its rim.

U.S. Pat. No. 4,813,570, discloses a container with a removable lid, the container having a side wall at the top of which there is provided an outwardly projecting bead or bead portions abutted by the lid, wherein the lid has a skirt with downwardly and/or inwardly facing cams. The container disclosed is said to enable a person with a handicapped hand or impaired vision to remove the lid from the container in a controlled manner such that the user is able to control the lid and/or container so that they do not suddenly slip from the user's grasp during the removal of the lid.

U.S. Design Pat. No. 284,944, discloses the ornamental design of a container for food having a removable lid.

Despite the presence of these various forms of containers, there exists a need for an easy opening, leak-resistant container which overcomes the negative aspects and disadvantages of prior art containers and lid functions.

SUMMARY OF THE INVENTION

According to the present invention there is provided a container designed for the storage and dispensing of foods, particularly liquid foods such as juices and other beverages. The container provides a substantially airtight and leak-resistant seal when closed with nominal finger pressure. At the same time, the container of the present invention requires only relatively light pressure to open same for pouring, and does not require the need for physical removal of the lid from the container body. Additionally, the entire lid may be easily removed for filling or cleaning purposes.

Provided is an easy-opening, leak-resistant liquid storage container having pour accommodating means, comprising: (a) a thermoplastic container body having pour accommodating means, the container body having substantially upright walls, the walls having an upper rim portion and a bottom portion, the upper rim portion having an inner surface and an outer surface; and (b) a removable thermoplastic lid, the lid comprising: (i) a cover section having an upper surface and a lower surface; (ii) a plug section integral to the lower surface of the cover section, the plug section having an outer peripheral surface adapted to substantially conform to the inner surface of the upper rim portion of the container body walls for providing a close conforming fit when the lid is installed on the container body; and (iii) a lip integral to the cover section, the lip spaced apart from the outer peripheral surface of the plug section, wherein the lip combines with the lower surface of the cover section and the outer peripheral surface of the plug section to form a track, the track having a pair of rocker points, whereby the rocker points are effective to release the lid from a closed position when a downward force is exerted upon the upper surface of the cover section of the lid.

An alternate embodiment also provides an easy-opening, leak-resistant liquid storage container, comprising: (a) a thermoplastic container body having substantially upright walls, the walls having an upper rim portion and a bottom portion, the upper rim portion having an inner surface and an outer surface; and (b) a removable thermoplastic lid having pour-accommodating means, the lid comprising: (i) a cover section having an upper surface and a lower surface; (ii) a plug section integral to the lower surface of the cover section, the plug section having an outer peripheral surface adapted to substantially conform to the inner surface of the upper rim portion of the container body walls for providing a close conforming fit when the lid is installed on the container body; (iii) a lip integral to the cover section, the lip spaced apart from the outer peripheral surface of the plug section, wherein the lip combines with the lower surface of the cover section and the outer peripheral surface of the plug section to form a track, the track having a pair of rocker points; and (iv) a pour orifice located in a portion of the plug section of the lid, the pour orifice positioned so as to be exposed when the lid is in a fully open position; whereby the rocker points are effective to release the lid from a closed position when a downward force is exerted upon the upper surface of the cover section of the lid.

In view therefore, it is an object of the present invention to provide a storage container having a substantially air-tight and leak-resistant seal between its lid and the periphery of the container body when the lid is in the closed position.

It is another object of the present invention to provide a container which is easily opened and closed.

It is a further object of the present invention to provide a container having pour-accommodating means from which the contents of the container can be easily poured without removing the lid.

It is yet another object of this invention to provide a container and lid system which is of simple two-piece construction that can be manufactured inexpensively while providing the desired seal and operation functions.

Other objects and the several advantages will become apparent to those skilled in the art upon a reading of the specification and the claims appended thereto.

BRIEF DESCRIPTION OF THE DRAWINGS

The present invention will become better understood by reference to the following detailed description when considered in connection with the accompanying drawings, wherein.

DETAILED DESCRIPTION OF THE INVENTION

The container of the present invention is best understood by referring to the appended figures, which are given by way of example and not of limitation.

Figure 1:
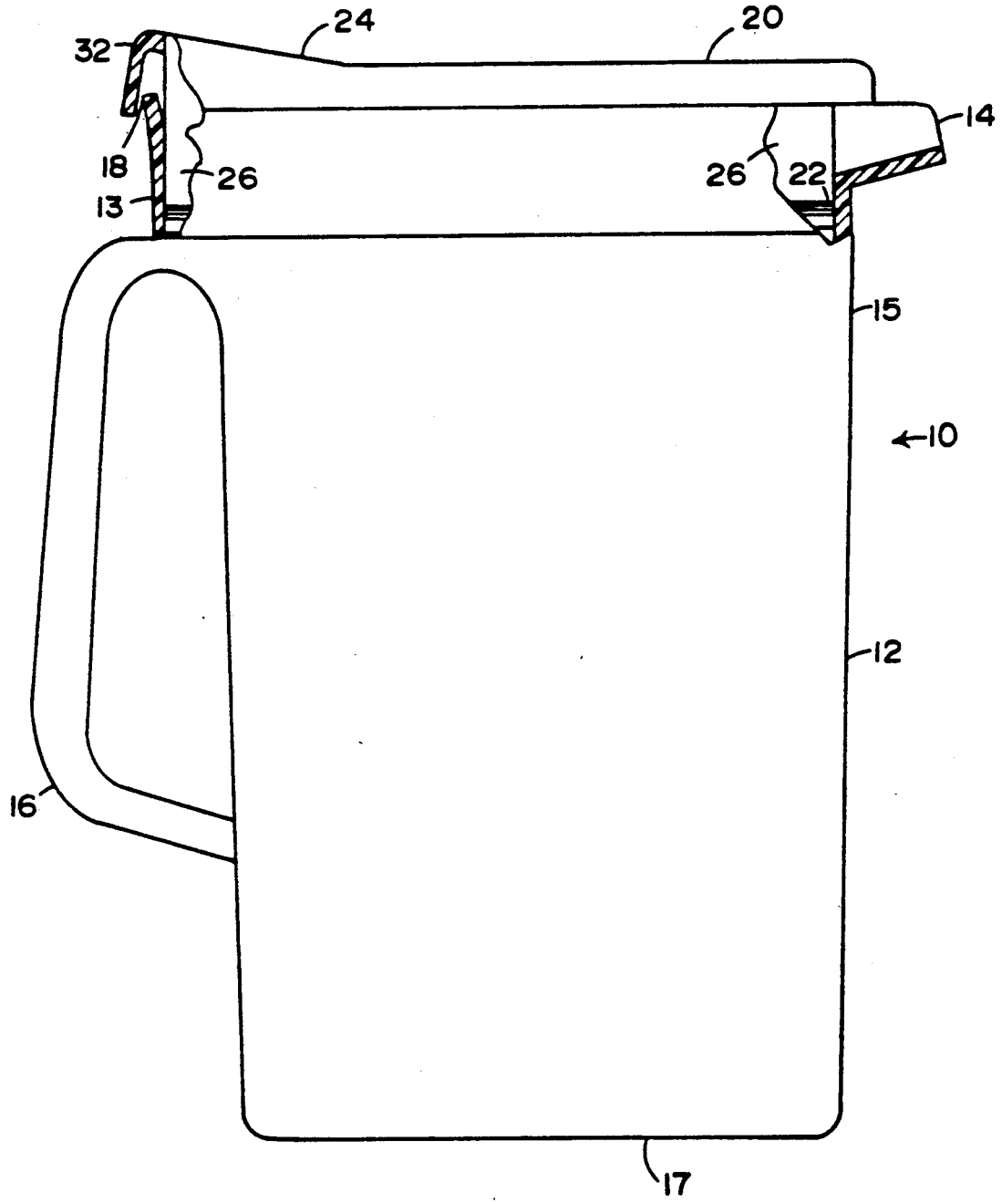
FIG. 1 presents a side view of one embodiment of the inventive container, shown in partial cutaway, the container having pour accommodating means located on the container body and depicted with its lid in a closed position.

Referring now to FIG. 1, the container 10 is shown with lid 20 installed in a closed position on container body 12. Container body 12, as is preferred, is of a shape and volume suitable for general home use, i.e., available storage space and pertinent human factors considered. Pour accommodating means can also be provided. As shown in FIG. 1, such pour accommodating means can be spout 14 which is integral to container body 12. In the alternate embodiment depicted in FIG. 8, such pour accommodating means can be formed in the lid structure. Handle 16 may be provided to facilitate ease in handling. Such a handle 16 can be located opposite from the pour accommodating means for ease of use.

Still referring to FIG. 1, the container body 12 can be further divided into a upper rim portion 13 and a bottom portion 15 for the purposes of description. Bottom portion 15 can be seen to be a basically simple open container. Although bottom portion 15 is shown having a plan form outline which is rectilinear and is coupled with a flat base 17 for in-use stand-up stability, plan form outlines ranging from circular to rectilinear will produce structures known to be acceptable for these purposes. Upper rim portion 13, as is preferred, has one simple continuous and constant bead means 30 running around its outer surface located substantially near the extreme top edge of the upper rim portion 13 of container body 12.

Figure 2:
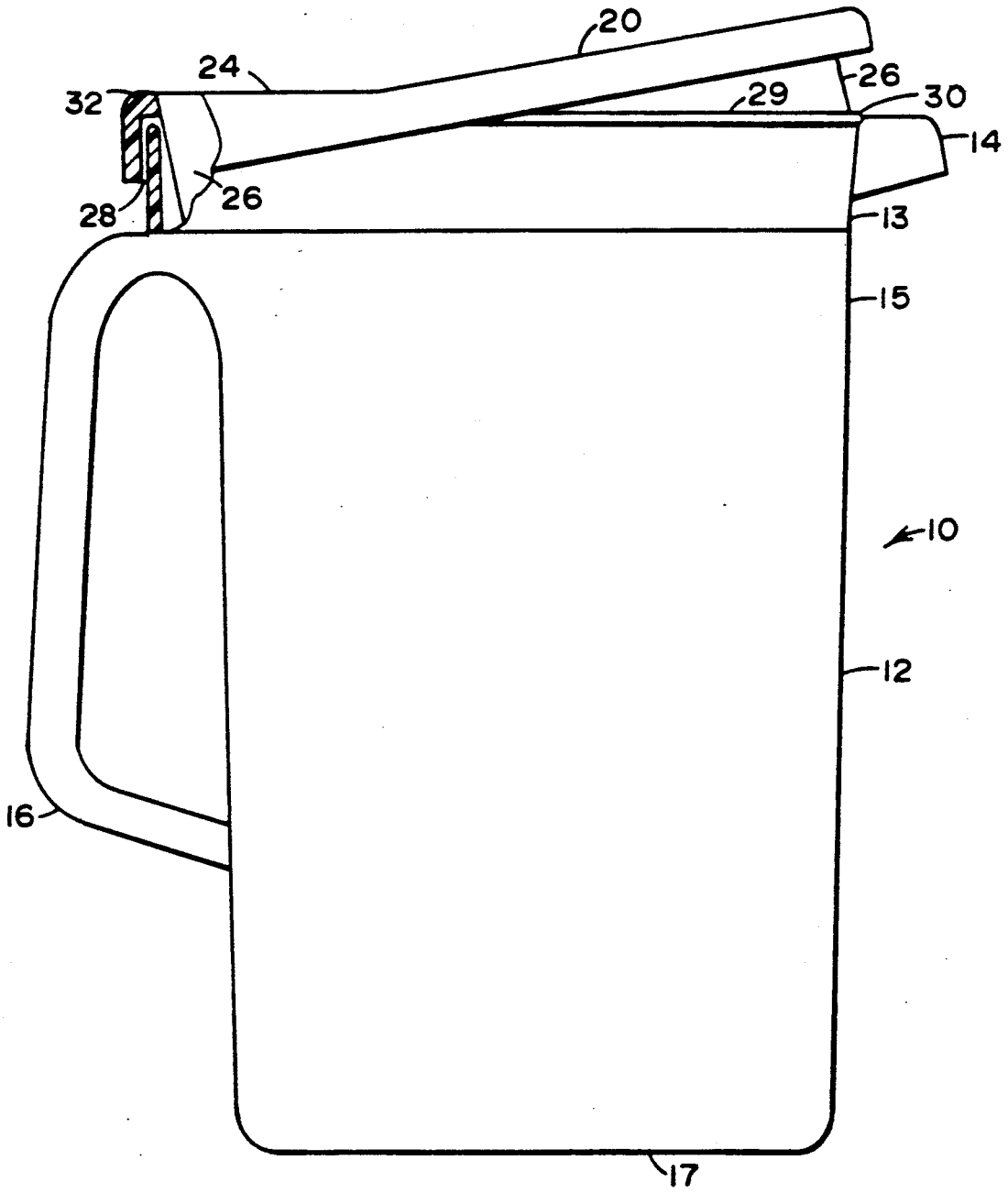
FIG. 2 presents a side view of the FIG. 1 embodiment of the inventive container, also shown in partial cutaway, the container being depicted with its lid in an open position from which its contents may thus be poured.

Referring now to FIG. 2, container 10 is shown in its open and pourable condition. In this condition, as is shown in the cutaway portion of this figure, a novel and effective means of container venting is provided in this particularly preferred embodiment. As can be appreciated from everyday experience, when pouring a liquid from a container having only one orifice, that orifice being used to dispense the liquid, the liquid will not pour from that container in an even and continuous manner; rather, its flow velocity will rise and fall in a periodic "chugging" manner. By providing a vent orifice, this phenomena will cease, resulting in a substantially uniform flow condition. As indicated in FIG. 2, vent channel 28 is provided when lid 20 is in the fully open position. As a result of its location and the particular configuration depicted in the preferred embodiment of FIG. 2, inadvertent spillage from vent channel 28 is avoided.

Figure 3:
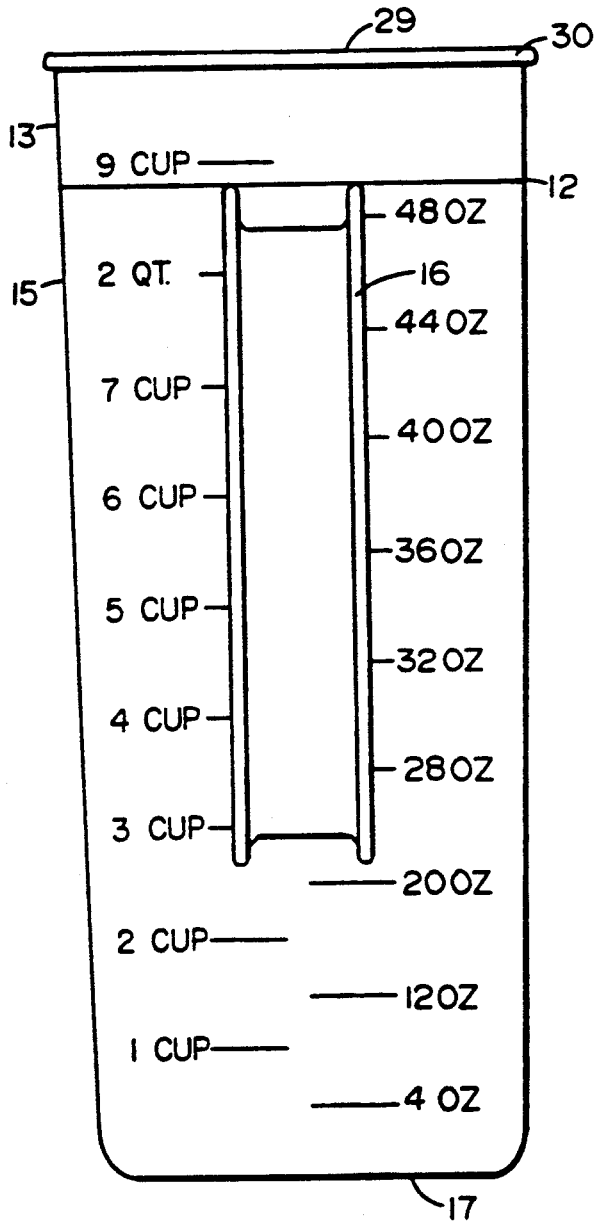
FIG. 3 presents a back, handle-end view of a container body, depicted with its lid removed.

Referring now to FIG. 3, a back view of container body 12 is shown. As indicated, container volume markings can be provided, enhancing the appeal of such a container to a user.

Figure 4:
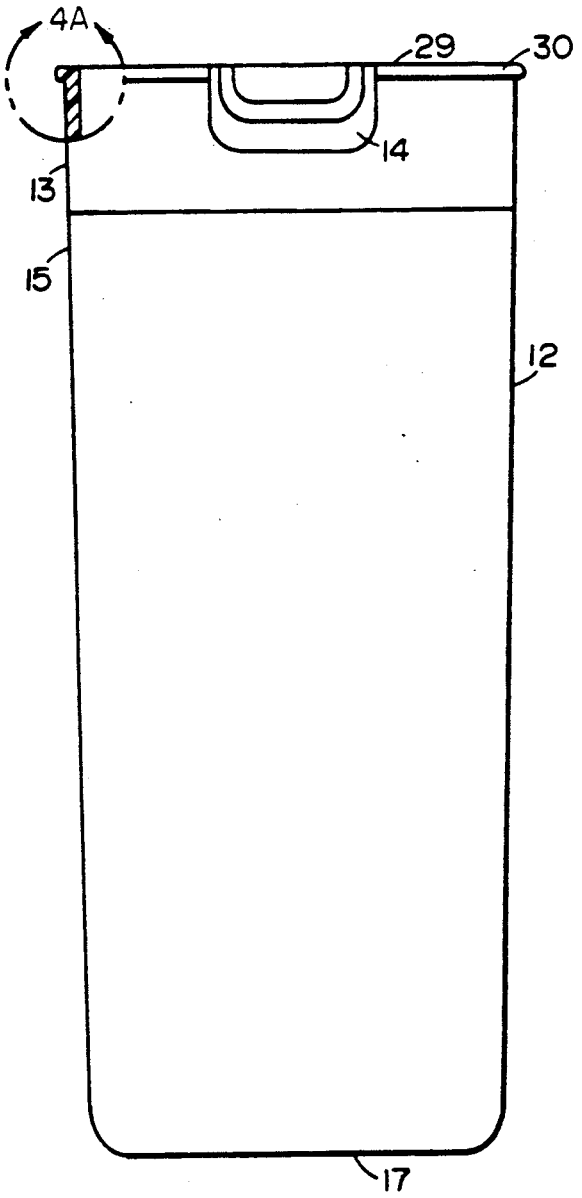
FIG. 4 presents a front, spout-end view of the FIG. 1 container body, depicted with its lid removed. A partial cutaway is also provided.
Figure 4A:
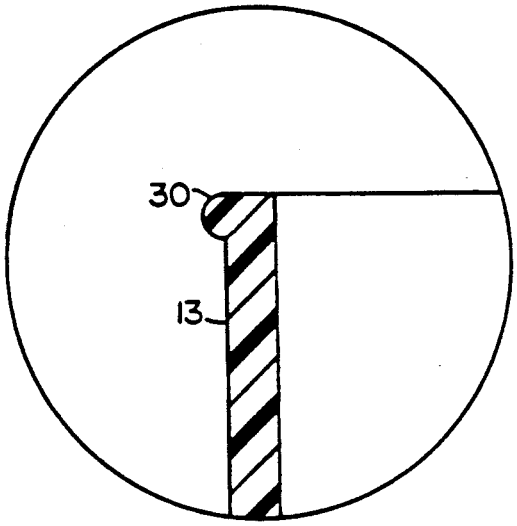
FIG. 4A presents Detail "A", an enlarged view of the cutaway section of FIG. 4.

In FIG. 4, a front view of container body 12 is presented. In FIG. 4A, a preferred geometry for bead means 30 is shown in an enlarged view.

Figure 5:
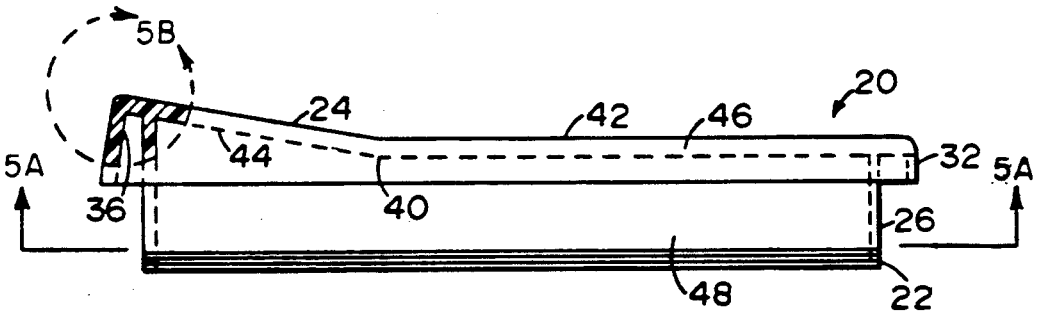
FIG. 5 presents a side view of an embodiment of a removable lid of the inventive container shown in partial cutaway.
Figure 7:
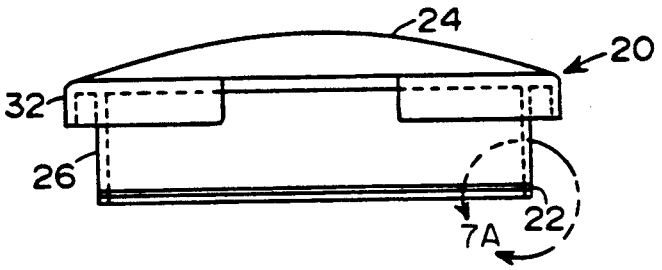
FIG. 7 presents a front view of a preferred embodiment of the removable lid of the inventive container.
Figure 7A:
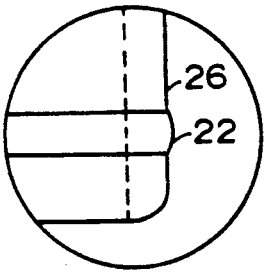
FIG. 7A presents Detail "C", an enlarged view of a portion of the view of FIG. 7.

Referring now to FIG. 5, a side view of removable container lid 20 of the present invention is shown. Removable lid 20 can generally be described as a rocker-type lid preferably matching the horizontal view plan section shape taken at the aforementioned container upper rim portion 13. As may be seen, in a preferred embodiment, lid 20 has an upwardly inclined rear section 24, in side view. Lid 20 has a cover section 46 having an upper surface 42 and a lower surface 44. Integral to lower surface 44 of cover section 46 is plug section 26. As is preferred, plug section 26 has an outer peripheral surface 48 adapted to substantially conform to the inner surface of the upper rim portion 13 of container body 12. As can be envisioned, such an arrangement provides an effective seal for the container 10. To further enhance sealing, an optional peripheral bead means 22 may be incorporated on outer peripheral surface 48 of plug section 26, in a preferred embodiment of the present invention. Peripheral bead means 22 is shown in greater detail in FIG. 7A. As a still further enhancement to sealing, peripheral bead means 22 can be matched to an optional recessed groove or cut (not shown) of substantially like dimension, formed or machined into the inner surface of upper rim portion 13 of container body 12 to provide a substantially liquid-tight plug-type locking seal.

Figure 5A:
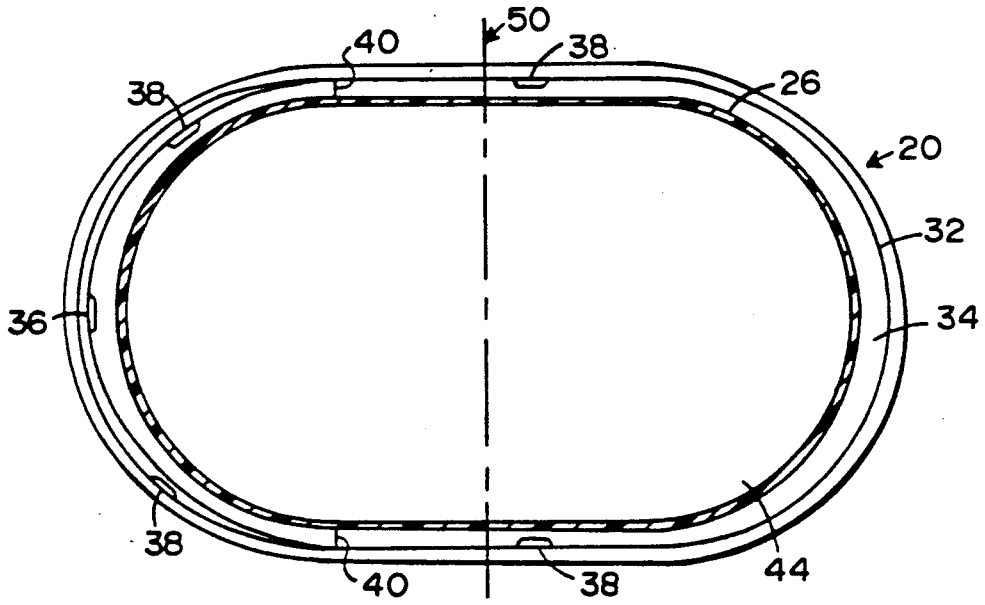
FIG. 5A presents a bottom view of the FIG. 5 removable lid embodiment taken along Section "A-A" of FIG. 5.
Figure 6:
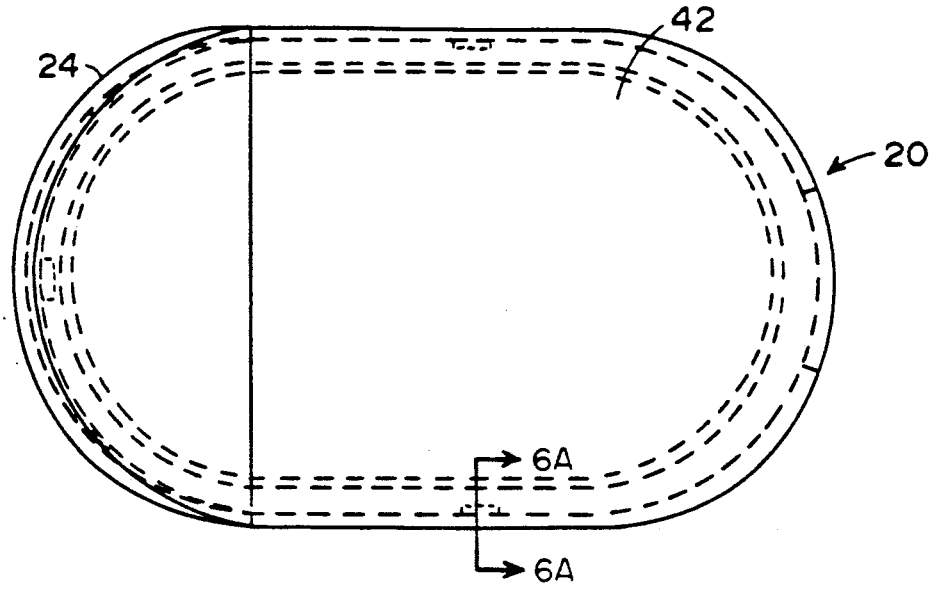
FIG. 6 presents a top view of the FIG. 5 removable lid.
Figure 6A:
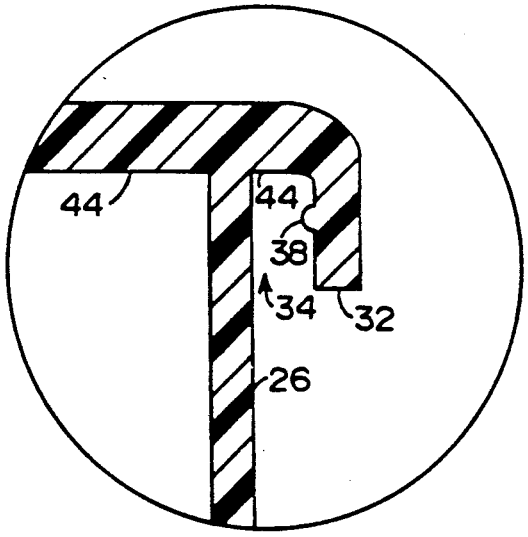
FIG. 6A presents an enlarged view of the removable lid embodiment taken along Section "B-B" of FIG. 6.

It can be seen that lid 20 has an outside perimeter lip 32 integral to cover section 46. Referring to FIG. 5A, in which a bottom view of the FIG. 5 embodiment taken along Section "A-A" is depicted, lip 32 is spaced apart from outer peripheral surface 48 of plug section 26. As can be appreciated from the depiction of lid 20 in FIGS. 5, 5A and 6A, lip 32 combines with outer peripheral surface 48 of plug section 26 and lower surface 44 of cover section 46 to form track 34. Track 34, as is preferred, is sized to fit upon upper rim portion 13 and over peripheral bead means 30 of container body 12. Within track 34, at the point where cover section 46 angles upward to form upwardly inclined rear section 24, are rocker points 40. As is preferred for ease of operation, rocker points 40 are located at a distance from centerline 50 of lid 20. The advantageous use of rocker points 40, positioned in the manner depicted in FIG. 5A results in an easy opening container whereby the rocker points are effective in releasing the lid from a closed position when a downward force is exerted upon upper surface 42 of cover section 46 of lid 20 in the region of upwardly inclined rear section 24. As can be seen by reference to FIG. 2, rocker points 40 operate by pivoting or rocking upon extreme top rim surface 29 of container body 12.

Referring again to FIG. 5A, the inner surface of lip 32, in a preferred embodiment, employs local projected latching lugs 38 (total of 4 shown) to hold lid 20 in place in the closed and sealed position. A local projected latching lug is shown in greater detail in the enlarged view if FIG. 6A. When container 10 is closed, local projected latching lugs 38 engage peripheral bead means 30 of container body 12, locking the lid closed. Leak-resistant sealing is effected in the closed position, as mentioned above, by the close conforming fit of outer peripheral surface 48 of plug section 26 to the inner surface of upper rim portion 13 of container body 12. A still more effective sealing of the container is achieved through the use of optional peripheral bead means 22, shown in FIG. 5, with even still more effective sealing with a recessed groove or cut (not shown) of like dimension to optional peripheral bead means 22 formed or machined into the inner surface of upper rim portion 13 of container body 12. An even more effective sealing of the container can be effected by employing a continuous latching bead (not shown) about the inner surface of lip 32. Such a bead, as can be envisioned, will engage peripheral bead means 30 of container 12 about the entire outer periphery of container body 12.

Figure 5B:
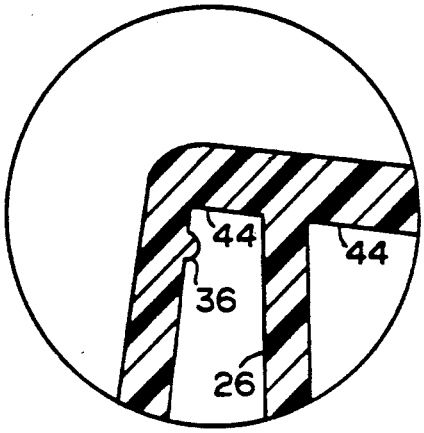
FIG. 5B presents Detail "B", an enlarged view of the cutaway section of FIG. 5.

When the lid is placed in the open condition for pouring, as depicted in FIG. 2, the lid may seek to close somewhat as a result of the fact that it is designed to pivot or rock from an off-center position, unless the user applies a continuous pressure to upwardly inclined rear section 24 during the pouring operation. To remedy this situation and add to the ease of operability of the present invention, a small retaining projected lug 36 is employed on the inner surface of lip 32 that will in the full open condition engage and latch over the container body 12's peripheral bead means 30. Retaining projected lug 36 is shown in greater detail in the enlarged view of FIG. 5B.

Figure 8:
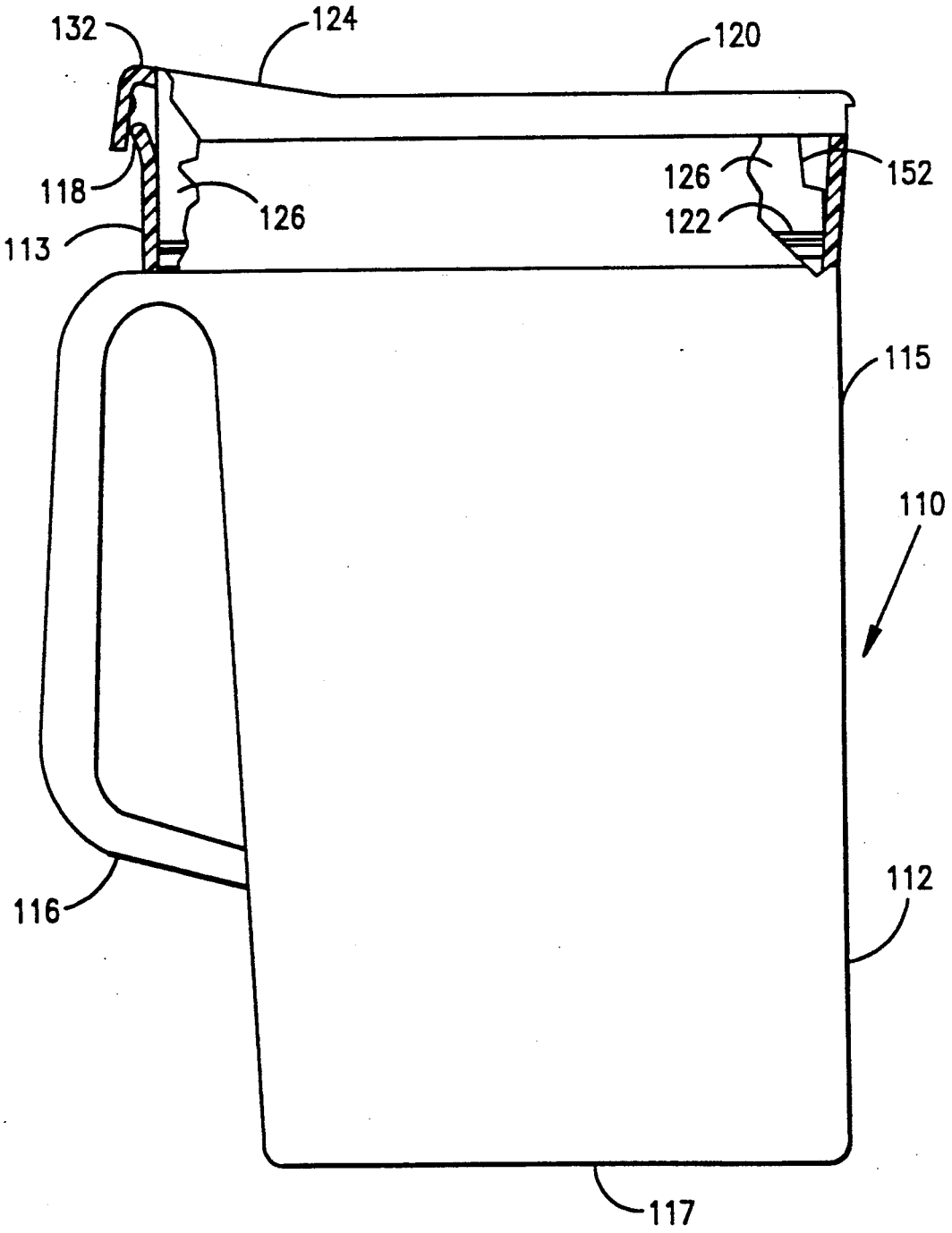
FIG. 8 presents a side view of an alternate embodiment of the inventive container, shown in partial cutaway, the container having pour accommodating means located in the lid of the container and depicted with the lid in a closed position.

FIGS. 8–12 are directed to an alternate embodiment which employs a pour accommodating means formed in the lid structure, itself. Referring to FIG. 8, container 110 is shown with lid 120 installed in a closed position on container body 112. As shown in the partial cutaway portion of FIG. 8, pour orifice 152 is provided within the lid 120. Handle 116 is provided to facilitate handling. Consistent with the embodiment of FIGS. 1–7, handle 116 is located opposite from the pour accommodating means. Container body 112 is divided into a upper rim portion 113 and a bottom portion 115 for purposes of description. Although bottom portion 115 is shown having a rectilinear plan form outline, coupled with a flat base 117 for in-use stand-up stability, other plan form outlines will produce structures acceptable for these purposes. Upper rim portion 113, as is preferred, has one simple continuous and constant bead means 130 running around its outer surface located substantially near the extreme top edge of the upper rim portion 113 of container body 112. As may be seen, no pour spout is provided in upper rim portion 113 of container body 112, although a pour spout could be provided which would act in cooperation with pour orifice 152. Such a configuration is considered to be within the scope of the present invention.

Figure 9:
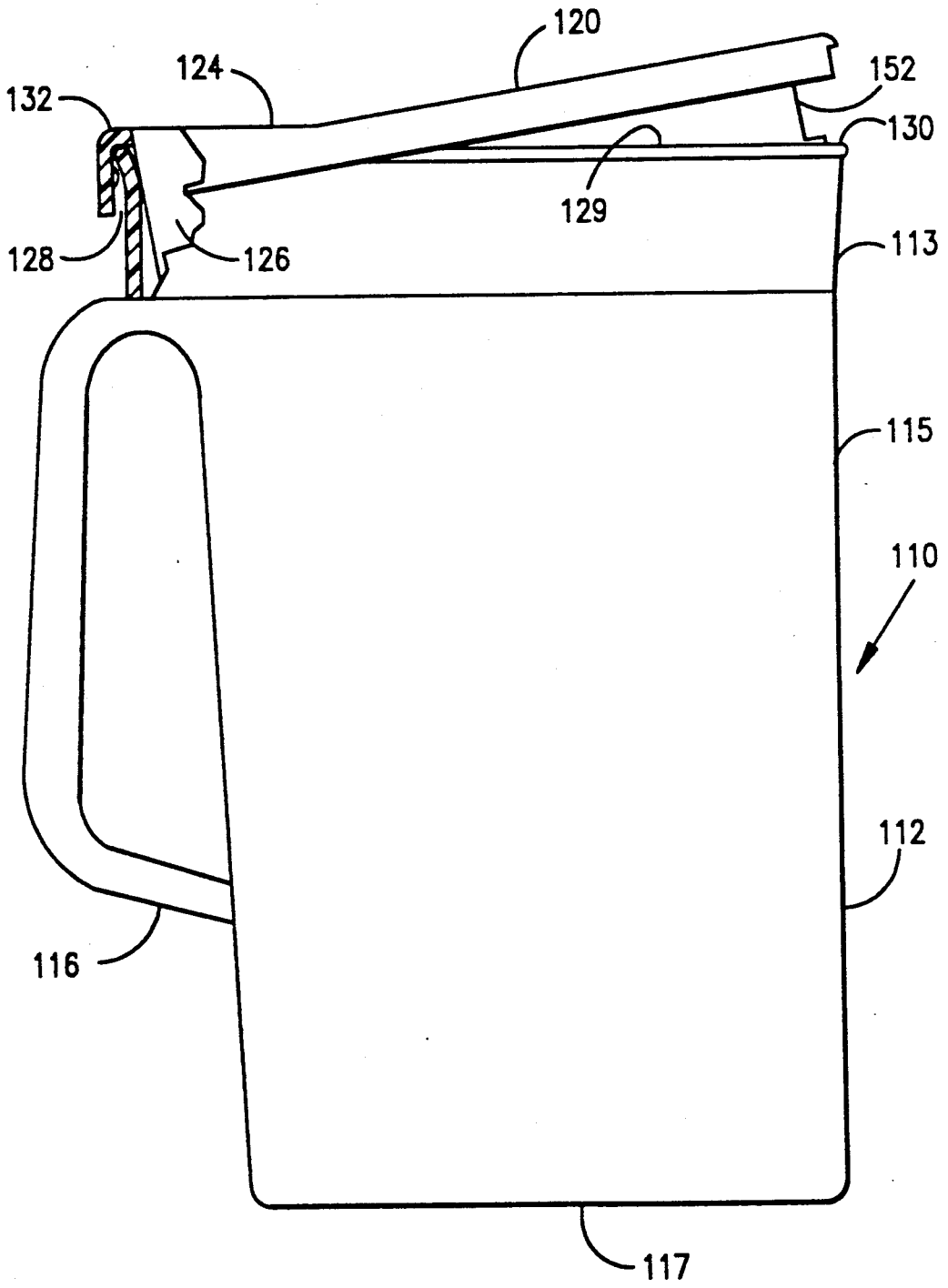
FIG. 9 presents a side view of the FIG. 8 embodiment of the inventive container, also shown in partial cutaway, the container being depicted with its lid in an open position from which its contents may thus be poured.

Referring now to FIG. 9, container 110 is shown in its open and pourable condition. When opened, consistent with the embodiment of FIGS. 1–7, effective container venting is provided by vent channel 128, shown in the partial cutaway portion of FIG. 9. As can be appreciated, due to its location and configuration, inadvertent spillage from vent channel 128 is avoided. When the container is placed in the open condition, pour orifice 152 is exposed to permit the contents of container 110 to be easily poured therefrom. As may be envisioned, an effective pour accommodating means is thus provided which does not require the use of a pour spout on container body 112.

Figure 10:
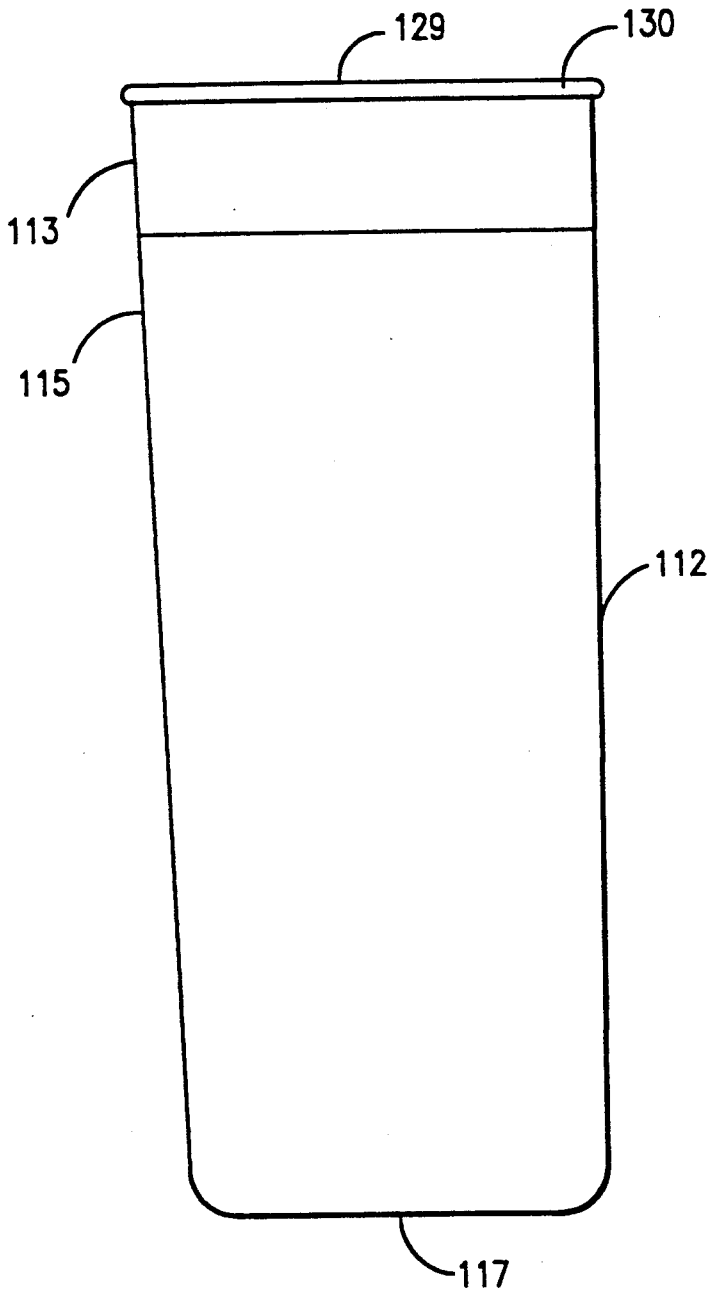
FIG. 10 presents a front view of the container body of the FIG. 8 embodiment depicted with the lid removed.

Referring now to FIG. 10, a front view of container body 112 is presented from which the differences between same and the container body of the embodiment of FIGS. 1–7 may be ascertained.

Figure 11:
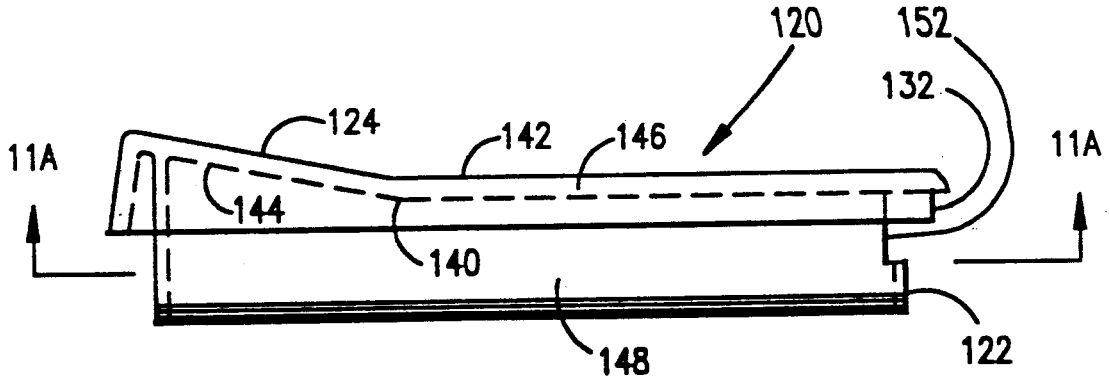
FIG. 11 presents a side view of a removable lid having pour accommodating means located therein for use with the inventive container of the FIG. 8 embodiment.

Referring now to FIG. 11, a side view of removable container lid 120 is shown. Removable lid 120 can generally be described as a rocker-type lid substantially matching the horizontal view plan section shape taken at container upper rim portion 113. As is preferred, lid 120 has an upwardly inclined rear section 124, in side view. Lid 120 also has a cover section 146 having an upper surface 142 and a lower surface 144. Integral to lower surface 144 of cover section 146 is plug section 126 which has an outer peripheral surface 148 adapted to substantially conform to the inner surface of the upper rim portion 113 of container body 112 to provide an effective seal for the container 110. To further enhance sealing, an optional peripheral bead means 122 may be incorporated on outer peripheral surface 148 of plug section 126. As described for the embodiment of FIGS. 1–7, a still further enhancement to sealing can be provided wherein peripheral bead means 122 is matched to an optional recessed groove or cut (not shown) of substantially like dimension, formed or machined into the inner surface of upper rim portion 113 of container body 112.

Figure 11A:
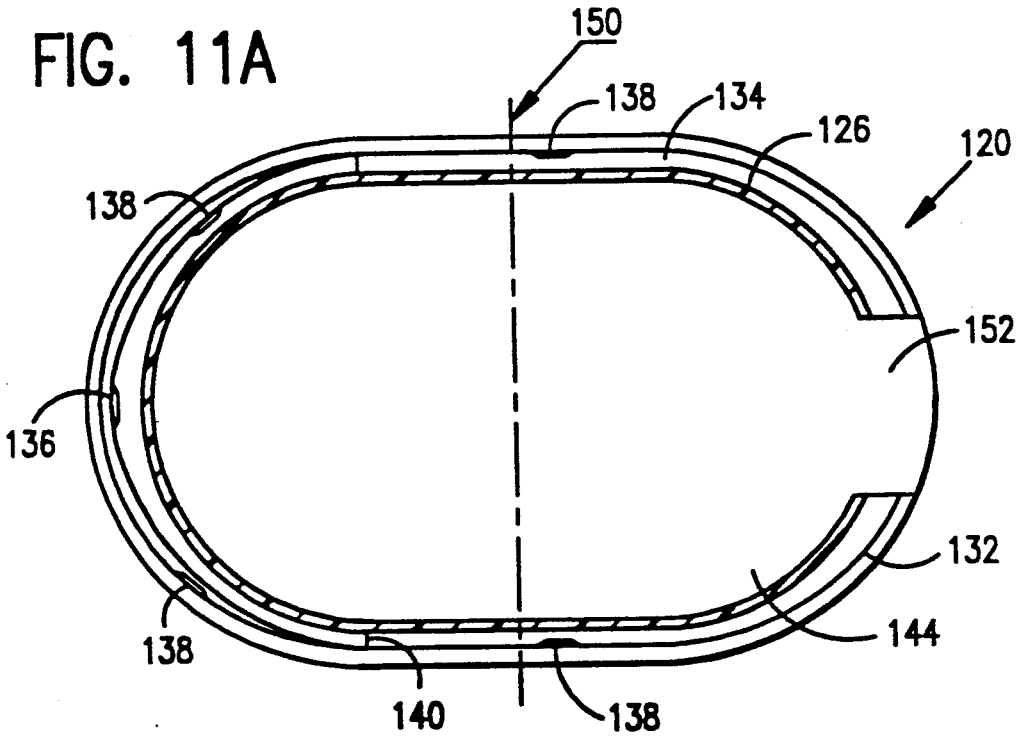
FIG. 11A presents a bottom view of the FIG. 11 removable lid embodiment taken along Section "C-C" of FIG. 11.

As was preferred for the embodiment of FIGS. 1–7, lid 120 has an outside perimeter lip 132 integral to cover section 146. Referring now to FIG. 11A, in which a bottom view of the FIG. 11 embodiment taken along Section "C-C" is depicted, lip 132 is shown to be spaced apart from outer peripheral surface 148 of plug section 126 to combine with outer peripheral surface 148 of plug section 126 and lower surface 144 of cover section 146 to form track 134. Track 134 is sized to fit upon upper rim portion 113 and over peripheral bead means 130 of container body 112. Within track 134, at the point where cover section 146 angles upward to form upwardly inclined rear section 124, are rocker points 140. As is preferred for ease of operation, rocker points 140 may be located at a distance from centerline 150 of lid 120. The advantageous use of rocker points 140, as depicted in FIG. 11A results in an easy-opening container whereby the rocker points are effective in releasing the lid from a closed position when a downward force is exerted upon upper surface 142 of cover section 146 of lid 120 in the region of upwardly inclined rear section 124. Referring again to FIG. 9, it may be seen that rocker points 140 operate by pivoting or rocking upon extreme top rim surface 129 of container body 112.

Referring again to FIG. 11A, the inner surface of lip 132, in a preferred embodiment, employs local projected latching lugs 138 (4 shown) to hold lid 120 in place in the closed and sealed position. As previously explained, when container 110 is closed, local projected latching lugs 138 engage peripheral bead means 130 of container body 112, locking lid 120 closed. Leak-resistant sealing is effected in the closed position by the close conforming fit of outer peripheral surface 148 of plug section 126 to the inner surface of upper rim portion 113 of container body 112. A still more effective sealing of the container may be achieved through the use of optional peripheral bead means 122, with even still more effective sealing with a recessed groove or cut (not shown) of like dimension to optional peripheral bead means 122 formed or machined into the inner surface of upper rim portion 113 of container body 112.

As described for the embodiment depicted in FIGS. 1–7, when the lid is placed in the open condition for pouring, as depicted in FIG. 9, the lid may seek to close somewhat due to the fact that it is designed to pivot or rock from an off-center position. To remedy this situation and add to the ease of operability, a small retaining projected lug 136 is employed on the inner surface of lip 132 that will, in the full open condition, engage and latch over peripheral bead means 130.

Figure 12:
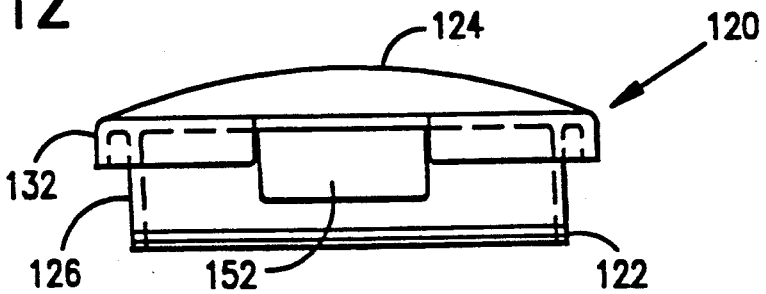
FIG. 12 presents a front view of a preferred embodiment of the removable lid of the inventive container of FIG. 8.

FIG. 12 presents a front view of the removable lid for use with container 110 of FIG. 8. Pour orifice 152 is shown in FIG. 12. Although pour orifice 152 is depicted as being a totally open, unrestricted orifice, vertical or horizontal restraining bars (not shown) may be employed across pour orifice 152 to serve the well-known purpose of restraining ice or other solid matter from being dispensed together with the liquid contained within.

Materials of choice contemplated for use in producing the containers of the present invention include a wide variety of thermoplastic materials. Preferred materials include polyethylene terephthalate (PET), both standard and engineering grades, polypropylene, including homopolymers, impact copolymers and random copolymers of propylene and ethylene, and polyethylene. Generally, a semi-rigid plastic compound is preferred for the container body and a softer durometer elastomeric plastic compound for the lid. As may be appreciated by those skilled in the art, such a combination of materials provides a controlled, simple but forgiving seal tolerance condition. When seeking to produce a clear, glass-like container body, polyethylene terephthalate is particularly preferred.

It is to be recognizing that the containers of the present invention are designed to be used in a generally upright position, except of course, when their contents are to be dispensed therefrom, the containers to be tilted in the usual manner to effect such dispensing. What is meant by the use of the term "leak-resistant" is that, when the container of the present invention is used to store a liquid, it can be so utilized in the conventional manner without the liquid spilling or seeping therefrom. A quantitative test to assess the leak resistance of liquid storage containers was devised wherein a container is filled with a measured quantity of water and its cover placed in the fully closed position. The container is then tilted from its vertical position to a fully horizontal position for 30 seconds and returned to the vertical position. The container is considered to be leak resistant if no more than 20 grams of water were lost from the container during the 30 second period. Thus, a leak-resistant container produced in accordance with the present invention could be used advantageously to shake a stratified juice-type product to achieve a homogeneous mixture for dispensing, without loss of liquid during that operation - a feature not ordinarily found in most containers designed for that purpose. The use of the term "leak-resistant" is not meant to imply that the container may be turned upside-down or handled in a non-conventional manner without the loss of some liquid, although a container produced according to the present invention, employing preferred embodiments, could achieve such a feature.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the amended claims.

What is claimed is:

1. An easy-opening, leak-resistant liquid storage container, comprising:

(a) a thermoplastic container body having pour-accommodating means, said container body having substantially upright walls, said walls having an upper rim portion and a bottom portion, said upper rim portion having an inner surface and an outer surface; and (b) a removable thermoplastic lid, said lid including:

(i) a cover section having an upper surface and a lower surface;

(ii) a plug section integral to said lower surface of said cover section, said plug section having an outer peripheral surface adapted to substantially conform to the inner surface of said upper rim portion of said container body walls for providing a close conforming fit when said lid is installed on said container body; and (iii) a lip integral to said cover section, said lip spaced apart from said outer peripheral surface of said plug section, wherein said lip combines with said lower surface of said cover section and said outer peripheral surface of said plug section to form a track, said track having a pair of rocker points;

whereby said rocker points are effective to release said lid from a closed position when a downward force is exerted upon the upper surface of said cover section of said lid.

2. The container of claim 1, wherein the pour-accommodating means is a pourable spout located in an upper portion of a wall of said container body.

3. The container of claim 2, further comprising a handle affixed to a wall opposite to the wall having said pourable spout.

4. The container of claim 2, wherein said removable lid further comprises a peripheral bead means located about said outer peripheral surface of said plug section.

5. The container of claim 2, wherein said rocker points of said removable lid are formed by an upwardly inclined contour of said lower surface of said cover section.

6. The container of claim 5, wherein said upper surface of said cover section of said removable lid follows the upwardly inclined contour of said lower surface of said cover section producing an inclined lid section.

7. The container of claim 2, further comprising a vent channel effective to permit a liquid to be poured from the container in a smooth and continuous manner when the container is in the open position.

8. The container of claim 2, wherein said lid further comprises a retaining locking lug effective to lock the lid in a fully open position.

9. The container of claim 1, wherein said container body is produced from a material selected from the group consisting of polyethylene terephthalate, polypropylene, random copolymers of propylene and ethylene and polyethylene.

10. The container of claim 9, wherein said lid is produced from a material selected from the group consisting of polypropylene, random copolymers of propylene and ethylene and polyethylene.

11. An easy-opening, leak-resistant liquid storage container, comprising:

(a) a thermoplastic container body having substantially upright walls, said walls having an upper rim portion and a bottom portion, said upper rim portion having an inner surface and an outer surface; and (b) a removable thermoplastic lid having pour-accommodating means, said lid including:

(i) a cover section having an upper surface and a lower surface;

(ii) a plug section integral to said lower surface of said cover section, said plug section having an outer peripheral surface adapted to substantially conform to the inner surface of said upper rim portion of said container body walls for providing a close conforming fit when said lid is installed on said container body;

(iii) a lip integral to said cover section, said lip spaced apart from said outer peripheral surface of said plug section, wherein said lip combines with said lower surface of said cover section and said outer peripheral surface of said plug section to form a track, said track having a pair of rocker points; and (iv) a pour orifice located in a portion of said plug section of said lid, said pour orifice positioned so as to be exposed when said lid is in a fully open position;

whereby said rocker points are effective to release said lid from a closed position when a downward force is exerted upon the upper surface of said cover section of said lid.

12. The container of claim 11, further comprising a handle affixed to a wall of said container body.

13. The container of claim 11, wherein said removable lid further comprises a peripheral bead means located about said outer peripheral surface of said plug section.

14. The container of claim 11, wherein said rocker points of said removable lid are formed by an upwardly inclined contour of said lower surface of said cover section.

15. The container of claim 14, wherein said upper surface of said cover section of said removable lid follows the upwardly inclined contour of said lower surface of said cover section producing an inclined lid section.

16. The container of claim 11, further comprising a vent channel effective to permit a liquid to be poured from the container in a smooth and continuous manner.

17. The container of claim 11, wherein the lid further comprises a retaining locking lug effective to lock the lid in a fully open position.

18. The container of claim 11, wherein said container body has volumetric markings positioned thereon.

19. The container of claim 11, wherein said container body is produced from a material selected from the group consisting of polyethylene terephthalate, polypropylene, random copolymers of propylene and ethylene and polyethylene.

20. The container of claim 19, wherein said lid is produced from a material selected from the group consisting of polypropylene, random copolymers of propylene and ethylene and polyethylene.

* * * * *